US007493666B2

(12) United States Patent
Mitchell

(10) Patent No.: US 7,493,666 B2
(45) Date of Patent: Feb. 24, 2009

(54) ROCKING APPARATUS FOR AN INFANT ENCLOSURE

(75) Inventor: Christopher Robert Murray Mitchell, Mermaid Beach (AU)

(73) Assignee: Babyhugs Developments Pty Ltd, Queensland (AU)

( * ) Notice: Subject to any disclaimer, the term of this patent is extended or adjusted under 35 U.S.C. 154(b) by 78 days.

(21) Appl. No.: 10/591,998

(22) PCT Filed: Aug. 3, 2005

(86) PCT No.: PCT/AU2005/000315

§ 371 (c)(1),
(2), (4) Date: Sep. 7, 2006

(87) PCT Pub. No.: WO2005/084497

PCT Pub. Date: Sep. 15, 2005

(65) Prior Publication Data

US 2007/0199147 A1 Aug. 30, 2007

(30) Foreign Application Priority Data

Mar. 8, 2004 (AU) ..... 2004901168

(51) Int. Cl.
*A47D 9/02* (2006.01)

(52) U.S. Cl. ..... 5/109; 5/108

(58) Field of Classification Search ..... 5/600–601, 5/101, 105, 107–109
See application file for complete search history.

(56) References Cited

U.S. PATENT DOCUMENTS

| | | | | |
|---|---|---|---|---|
| 3,225,365 | A | 12/1965 | Miller | |
| 3,802,003 | A | 4/1974 | Laurieti | |
| 4,793,010 | A * | 12/1988 | Gross et al. | 5/109 |
| 5,742,960 | A * | 4/1998 | Shamir | 5/107 |
| 6,971,127 | B2 * | 12/2005 | Richards | 5/108 |

FOREIGN PATENT DOCUMENTS

| | | |
|---|---|---|
| DE | 2981785 | 2/1999 |
| FR | 2317149 | 2/1977 |
| RU | 2055511 | 3/1996 |

* cited by examiner

*Primary Examiner*—Fredrick Conley
(74) *Attorney, Agent, or Firm*—Hoffman, Wasson & Gitler

(57) ABSTRACT

Apparatus (10) for moving or rocking an infant enclosure such as a cot (11) having legs (12), the apparatus (10) having at least one active module (15) and passive modules (14), each module (14, 15) having a spring mounted socket for receiving a leg (12) of the cot (11) and the active module (15) having a motor means to impart motion to the cot (11).

14 Claims, 4 Drawing Sheets

ROCKING APPARATUS FOR AN INFANT ENCLOSURE

TECHNICAL FIELD

This invention relates to rocking apparatus for moving or rocking an infant enclosure such as a cot pram or stroller and in a particular aspect to apparatus for use with or associated with baby or infant cots, prams or strollers to effect movement thereof for the purpose of encouraging sleep of babies or infants therein.

BACKGROUND ART

It is common where it is desired to induce sleep by a baby or infant to subject the baby or infant to a rocking or other similar motion. It is also known that the motion of a vehicle is particularly effecting in encouraging a baby or infant to sleep. Where a baby or infant is located in a pram or stroller, a mother or person having the care of the infant or baby often will move the pram back and forward by hand in an attempt to induce the baby or infant to sleep. This obviously is a tedious and not always effective task as a simple backwards and forwards motion is often not sufficient to achieve the desired results.

A number of different forms of mechanical or electromechanical apparatus have been proposed to effect movement of a pram, stroller or cot. Some of the known devices simply reproduce the manual motion applied to a pram or stroller referred to above by having an arm which is coupled to the pram or stroller and which is reciprocated back and forth. These devices suffer the above referred to disadvantages in that the motion which they impart to a pram or stroller is a simple reciprocating back and forward motion. Other devices have a platform upon which the whole pram stroller or cot is supported with the platform being moved by a motor device to effect movement of the pram, stroller or cot. Both the latter forms of device have not proved particularly effective due to the nature of the motion imparted to the cot, pram or stroller. These devices furthermore are usually large, difficult to use and or/relatively expensive.

SUMMARY OF THE INVENTION

The present invention aims to provide apparatus for moving or rocking an infant enclosure which is of a simple construction and which is particularly effective in inducing sleep in an infant or baby with the enclose. Other objects and advantages of the invention will become apparent from the following description.

The present invention thus provides in one preferred form apparatus for moving or rocking an infant enclosure of the type having legs by which said enclosure is normally supported on an underlying surface, said apparatus comprising a plurality of support means adapted to be associated with respective said legs, at least one of said support means including or being associated with motion imparting means for imparting a motion to said enclosure, and means for selectively actuating said motion imparting means.

The support means may be interposed between the legs and the underlying surface or may be incorporated in the legs.

The term "infant enclosure" as used throughout the specification includes prams, strollers or other mobile baby or infant carrier which usually have at least a three-point support defined by respective legs. Most commonly prams, strollers or other mobile carriers have at least three or four legs terminating in respective wheels defining a three- or four-point support. The term "infant enclosure" also includes stationary enclosures such as cots or beds having at least two legs. Typically cots or beds have four legs providing a four point support however cots or beds may only have two legs which for example provide a continuous support along opposite sides or ends of the enclosure. The term "infant enclosure" further includes stands for cots, beds, bassinets or the like which usually have at least a three point support, four example three or more legs.

The term "legs" as used throughout the specification includes any form of support by which the enclosure can be supported on an underlying support surface and includes legs provided with wheels, rollers or casters.

The motion imparted to the enclosure is suitably an oscillating or reciprocating motion. Preferably, the oscillating or reciprocating motion comprises a vertical or substantially vertical motion. The motion however may also include a component in a horizontal plane. The oscillating or reciprocating motion may comprise a constant motion or variable motion. The oscillating or reciprocating motion may be a motion of constant amplitude or variable amplitude. The oscillating or reciprocating motion may be a motion of fixed rate or variable rate.

In a preferred form, one or more of the support means comprises active support means and includes or is associated with the motion imparting means. Other of the support means suitably comprise passive support means which include means for facilitating the continuation of motion in the enclosure imparted by said motion imparting means. The means for facilitating the continuation of motion in the enclosure may comprise springs or other resilient or elastic means associated with one or more of the other support means. Thus the resilient support means may be defined by or include springs, pads of resiliently deformable material such as pads or rubber or plastics or other means with similar properties.

The motion imparting means of the active support means for inducing movement in the enclosure may comprise an actuator. The actuator may comprise a vibratory actuator which when actuated induces a vibration in the active support means. Preferably however the actuator includes a member which when actuated will impart a vertical or substantially vertical reciprocating or oscillating motion to the leg of the enclosure supported by the active support means. The means for selectively actuating the motion imparting means suitably comprise means to control the actuator to enable actuation thereof as required. The actuator may be a mechanical or electrical actuator. Where the actuator is an electrical actuator, a power supply for the actuator may be incorporated in the active support means. The power supply may typically comprise batteries. Alternatively power for the actuator may be derived from a remote power source such as a mains power supply connected to the active support means.

In another form, active support means incorporating motion imparting means may be associated with more than one leg to impart motion to the one or more legs. The motion imparted by the active support means in at least one of the legs may be different from the motion imparted by the active support means in the other legs. The motion imparted by one of the active support means may be different from the motion imparted by the other active support means. The differences in motion may comprise a difference in frequency of motion or difference in extent or amplitude of motion. The motion imparted by one of the active support means may be in phase with the motion imparted by one or more of the other active support means or out of phase with that motion. Active support means may be associated with all legs of the enclosure.

Where the apparatus includes more that one active support means, the actuator of each active support means may be actuable independently of the actuation of the actuators of the other active support means. Preferably also the motion imparted by the actuator of each active support means is different from the motion imparted by the actuators of each of the other active support means.

The or each active support means may comprise a self-contained unit. Alternatively the or each active support means may be linked to a controller of a common control unit. The control unit may selectively control the amplitude or motion or speed of operation of the actuators of each active support means.

Two or more actuators of the active support means may be actuated to impart a particular motion in the enclosure. For example, the actuators of the active support means on one side of the enclosure may be actuated simultaneously in phase and actuators of the active support means on the other side of the enclosure also actuated simultaneously in phase but out of phase with the actuators on the one side of the enclosure to impart a side to side rocking motion in the enclosure. Alternatively, actuators of the active support means at opposite ends of the enclosure may be actuated in a similar manner to impart an end-to-end rocking motion in the enclosure.

The actuator of an active support means suitably includes an actuator member which may be selectively reciprocated or oscillated. The actuator member suitably is oriented in use substantially vertically such as to induce at least a vertical reciprocation or oscillation of the leg of the enclosure associated with that support means. The actuator suitably comprises a solenoid actuator and the actuator member suitably comprises the solenoid coil of the actuator. Alternatively, the actuator member comprises the armature or an extension of the armature of the solenoid actuator. Other forms of actuator however may be provided for imparting a motion in a leg of the enclosure. For example, the actuator member may comprise a rotatable member. The rotatable member may comprise a cam or crank for reciprocating or oscillating the enclosure leg. In yet a further form, the rotatable member may comprise an off-centre weight which when rotated will impart a vibratory motion to the leg.

The passive and active support means suitably comprise passive and active modules on or in which respective legs of the enclosure are supported. The passive and active support modules may include a socket or saddle for receiving the leg of the enclosure. Where the legs terminate in wheels or rollers, the socket or saddle are suitably configured to receive a wheel or roller. The socket or saddle may comprise a concave socket. Means may be provided to positively but releasably secure the legs, wheels or rollers to the sockets or saddles. Such means may comprise any suitably fastening means such as clips or ties.

Each support module suitably includes a resilient support such as a spring suitably a compression spring on which the socket or saddle is supported for resilient movement. Preferably each support module includes a housing which houses the spring or other resilient support. Preferably the spring extends between the socket and base of the housing to support the socket or saddle for resilient movement in a substantially vertical direction.

The actuator of the active support means may be mounted on the socket or saddle whereby actuation thereof imparts an oscillating or reciprocating movement to the socket. Where the actuator is a solenoid actuator one of the members of the actuator may be connected to the socket. The member may be directly connected to the socket such that movement thereof when the solenoid actuator is actuated causes a corresponding movement of the socket. Alternatively the solenoid actuator may be supported by the socket such that actuation thereof causes a movement of the socket against the resilient support.

Preferably the solenoid members comprise an armature and a coil. The armature of the solenoid is preferably rigidly connected to the socket and suitably is oriented substantially vertically. Thus when current is applied to the coil the coil moves relative to the armature. Preferably the coil moves substantially vertically along the armature. When current is removed from the coil, the coil suitably drops under the influence of gravity. Preferably the momentum of the coil causes partial compression of the resilient support. Most preferably the coil is weighted. Means may be provided to cushion movement of the coil. Such means may comprise one or more springs which may be connected between the coil and armature.

The active module suitably include control means to control the supply of current to the solenoid coil. Preferably the supply of current is a momentary supply of current such as a pulsed current supply. The control means suitably also includes means for selecting the time for which the current is supplied to the solenoid coil. The control means also includes means for selecting the rate at which the pulsed current is supplied to the solenoid coil. A remote control unit may be associated with the control means for remote control of the active module.

BRIEF DESCRIPTION OF THE DRAWINGS

In order that the invention may be more readily understood and put into practical effect, reference will now be made to the accompanying drawings which illustrate a preferred embodiment of the invention and wherein:—

DETAILED DESCRIPTION OF THE PREFERRED EMBODIMENT

Figure 1:
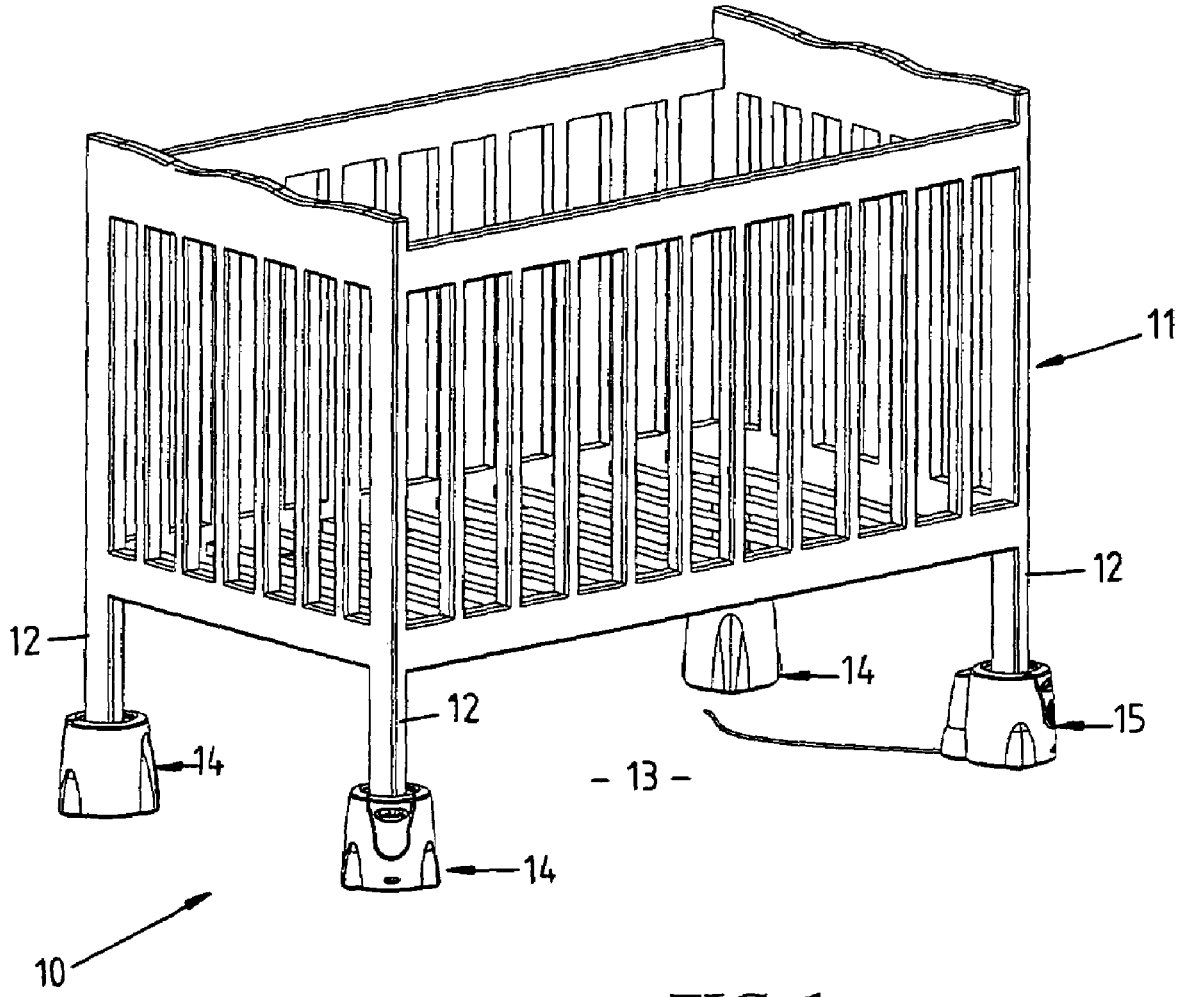
FIG. 1 illustrates one form of rocking apparatus according to an embodiment of the invention associated with a cot.

Referring to the drawings and firstly to FIG. 1, there is illustrated rocking apparatus for use with a baby's cot, pram or stroller in the illustrated embodiment, a cot 11 which as is conventional has four legs 12 at each corner normally providing a four point support for the cot 11 on an underlying surface 13 such as a floor surface. The rocking apparatus 10 comprises four leg support modules, comprising in this embodiment support modules 14 and 15 of two different configurations. In the illustrated embodiment, the rocking apparatus 10 includes three support modules 14 comprising passive support modules and one support module 15 comprising an active support module. The modules 14 and 15 are positioned beneath respective legs 12 such that the legs 12 of the cot 11 are supported to the floor surface 13 through a support module 14 or 15.

Figure 2:
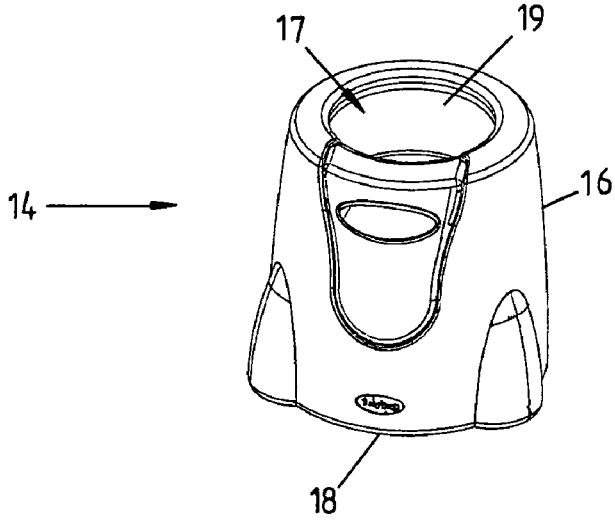
FIG. 2 illustrates a passive module of the rocking apparatus of FIG. 1.
Figure 5:
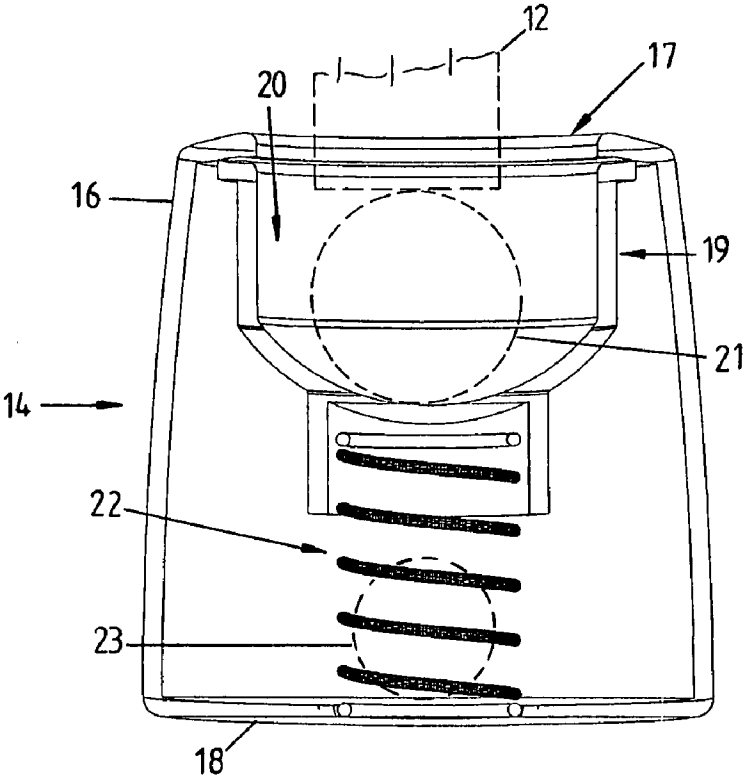
FIG. 5 is an enlarged sectional view of the passive module of FIG. 2.

Each support module 14 as shown in FIGS. 2 and 5 includes an outer hollow housing 16 which is open at 17 at its upper end to receive the lower end of the leg 12 but which is closed at its lower end to form a base 18 which may seat stably on the underlying support surface 13. Located within the housing 16 is a hollow cup-shaped member 19 which defines a socket 20 in which the lower end of a leg 12 may locate. The sockets 20 are configured to accept a large range of legs 12 or feet of legs 12 of different configurations with or without wheels. The sockets 19 for this purpose typically are of a hollow concave configuration. Such a configuration also permits the wheels 21 (shown in dotted outline) of a cot, pram or stroller to be located securely in a socket of respective support modules 14 (or 15).

The hollow cap-shaped member 19 is supported on a compression spring 22 which is seated on the base 18 of the housing 16 and extends into a hollow spigot on the underside of the member 19 such as to provide a spring mounting for legs 12 of the cots 11 supported on the modules 14. A ball 23 of resilient or cushioning material is provided internally of the spring 22 to cushion excessive movement of the member 19 and prevent "bottoming out". Alternatively, resilient cushioning means may be provided externally of the spring 22 for example as an annular ring on the base 18 and surrounding the spring 22.

Figure 3:
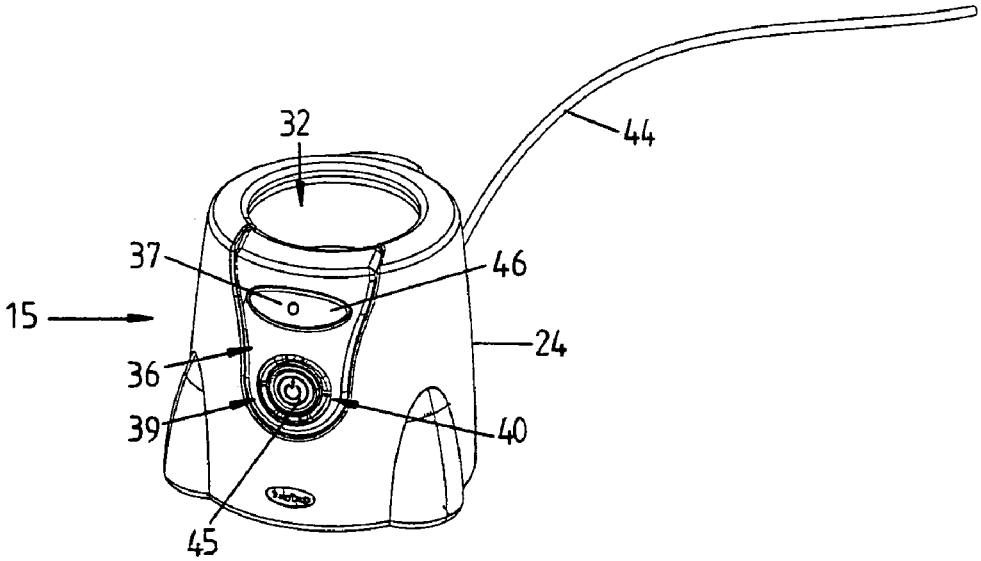
FIG. 3 illustrates an active module of the rocking apparatus of FIG. 1 with associated remote control unit.
Figure 4:
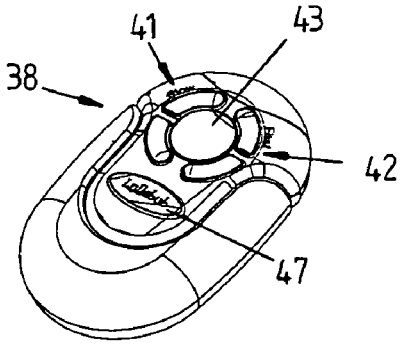
FIG. 4 is a view from the rear of the active module of FIG. 3.
Figure 4:
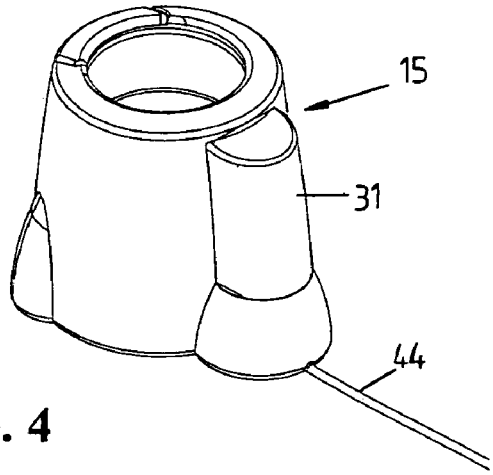
Figure 6:
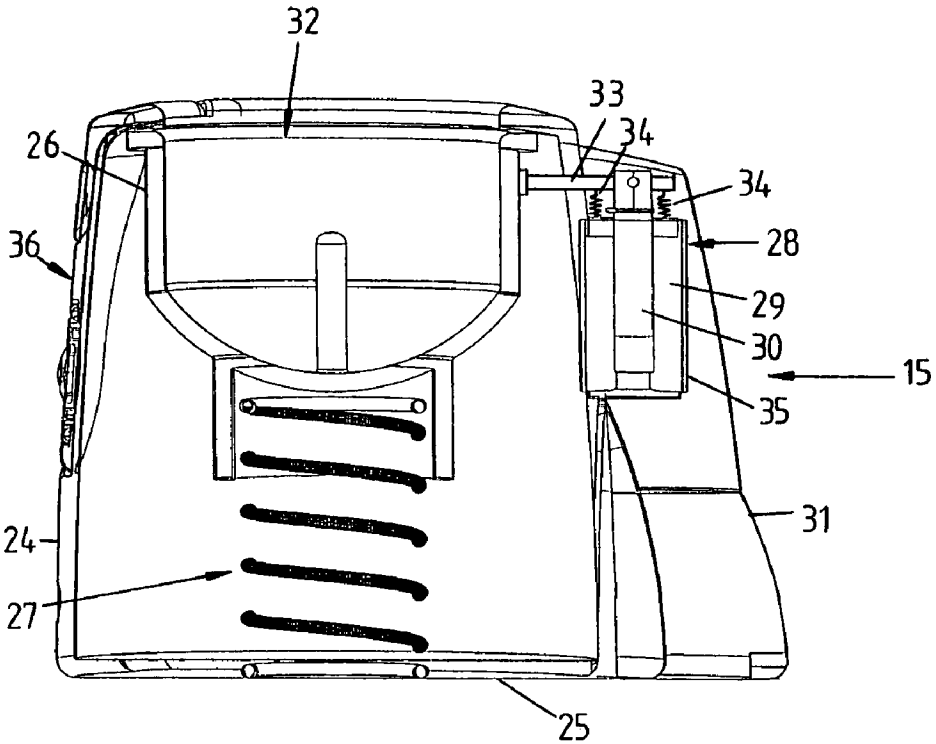
FIG. 6 is an enlarged sectional view of the active module of FIGS. 3 and 4.

The active support module 15 as shown more clearly in FIGS. 3, 4 and 6 is similar in configuration to the module 14 and has an external housing 24 and base 25 which can seat on the surface 13 with a hollow cup shaped member 26 similar to the member 19 located with the housing 24 and supported on a compression spring 27 in this case however, the module 15 includes within the housing 26, a solenoid actuator 28 having a solenoid coil 29 and an armature 30 with the solenoid actuator 28 being positioned in an extended portion 31 of the housing 24. The actuator 28 is oriented such that the armature 30 thereof is substantially vertical when the base 25 is seated upon the surface 13. As with the housing 16, the housing 24 is open at 32 at its upper end to receive the leg of a cot or other enclosure.

The armature 30 of the actuator 28 is connected rigidly at its upper end to a laterally extending arm 33 of the member 26 such that the actuator 28 hangs from the arm 33. The solenoid coil 29 is also supported to the arm 33 by tension springs 34. The arm 33 may be formed integrally with the member 26 or comprise a separate member secured to the member 26 such as by being threaded into the member 26. The solenoid coil 29 is also weighted by an external weight 35 typically a 500 gram weight which surrounds the coil 29 to increase the momentum of the coil 29 when the actuator 28 is operated.

The module 15 additionally includes an electronic control interface panel 36 for controlling operation of the solenoid actuator 28. The interface panel 36 includes a sensor 37 for receiving signals from an infra-red remote control unit 38 (see FIG. 3). The interface panel 36 includes control circuitry connected to the actuator 28 to control the supply of current to the actuator 28 and thus the rate of reciprocation of the coil 29 and attached weight 35 relative to the armature 30. The control circuitry within the interface 36 also includes a timing circuit to control the time for which current is supplied to the actuator 28. Two pairs of switches 39 and 40 on the interface panel 36 enable the user to select a slow mode or fast mode of operation of the solenoid 28 and the time for which the solenoid actuator 28 operates and thus the time the active module remains active. Corresponding sets of switches 41 and 42 are provided on the remote control unit 38 to allow remote selection of the mode of operation of the solenoid actuator 28. The switches 39 and 40 may also display the mode of operation selected such as by a liquid crystal or light emitting diode array. The display may additionally comprise a moving display to provide an indication of the time for which the active module remains active.

In the fast mode of operation the solenoid actuator 28 is actuated typically about four times a second whilst in the slow mode the solenoid actuator 28 is actuated ones every three to four seconds. These times of course may be varied. After selection of the mode, the active module 15 may be activated by a push button switch 43 on the unit 38. The interface panel 36 and control circuitry therein are connectable to an external power supply such as a plug in power pack through cable 44 and ON-OFF switch 45. The module 15 additionally includes a night light 46 which may be actuated through the control circuitry and by a switch 47 on the remote control unit 38. As an alternative, power for the module 15 may be provided by batteries within the module 15.

Actuation of the solenoid actuator 28 by energising the coil 29 thereof will create a magnetic field in the coil 29 to cause it to move substantially vertically upwardly whist de-energising the coil 29 will allow the coil 29 to drop downwardly under the influence of gravity back to its neutral position. The springs 34 cushion the dropping movement of the coil 29 and attached weight 35 so that the coil 29 bounces up and down until it reaches an at rest position. The initial dropping movement of the coil 29 and weight 35 will cause the spring 27 to be compressed and the spring 27 will thereafter move back towards its non activated position. This movement is thus transmitted to the leg 12 of the cot 11. Repeated movement of the coil 29 by repeated momentary or pulsed supply of current to the actuator 28 will create a vibratory movement in the spring 27 in a substantially vertical direction which is transmitted to the cot 11 through the leg 12 supported in the member 26.

In the embodiment of FIG. 1, the cot 11 has three legs 12 supported on respective passive modules 14 and the forth leg supported on an active module 15. Thus when current is supplied to the actuator coil 29 under control of the remote control unit 38 (or directly from the module 15), the movement of the coil 29 and weight 35 relative to the armature 30 will apply a momentary downward force to the spring 27 and thus to one leg 12 of the cot 11. Due to the spring mounting of the other three legs 12 on the passive modules 14 provide by the springs 22, the momentary vertical force applied to the one leg 12 will induce an oscillating or rocking motion in the cot 11 and the springs 22 of the modules 14 will facilitate the continuation of the reciprocating or oscillating motion of the cot 11. Thus when the leg 12 carried by the module 15 drops as the spring 27 is compressed, the opposite diagonal leg 11 will lift upwardly. The springs 22 of the other modules 14 are compressed also during this movement and cause an undulating rocking movement of the whole enclosure 11 similar to the movement of a vehicle. The springs of the respective modules 14 and 15 in effect form an independent four-point suspension for the cot 11.

Unless a further current pulse is supplied to the actuator 28, the amplitude of movement of the cot 11 will reduce back to zero whilst continued supply of pulses of current will continue the movement of the cot 11 at a selected desired rate. Thus the solenoid actuator 28 under the control of the control circuitry in the interface 36 can be activated at regular intervals to maintain the oscillating or rocking motion in the cot 11. This motion created in the cot 11 will encourage a baby or infant within the cot 11 to sleep. The control circuitry will cease supply of current to the solenoid actuator 28 after a predetermined period of time as determined by operation of the selected switches 39 and 40 or 41 and 42.

Figure 7:
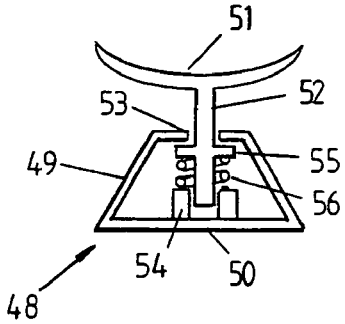
FIG. 7 is a sectional schematic view of an alternative form of passive module of the rocking apparatus.

FIG. 7 illustrates an alternative passive support module 48 for use in the rocking apparatus of the invention, the module 48 including a hollow housing 49 having a base 50 which may seat stability on the underlying support surface. A socket 51 is mounted to a substantially vertical shaft 52 or formed integrally with the shaft 52 which extends into the housing 49. Upper and lower guides 53 and 54 guide the shaft 52 in vertical reciprocating or oscillating movement. The shaft 52 also includes a radially extending flange 55 and a compression spring 56 is positioned between the flange 55 and base 50 of the housing 49 such as to provide a spring mounting for legs 12 of the cot 11 supported on the modules 48.

Figure 8:
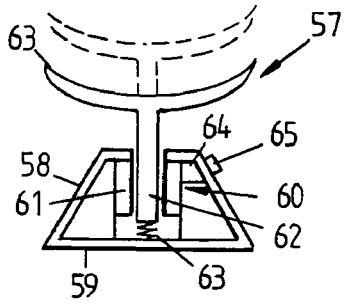
FIG. 8 is a sectional schematic view of an alternative form of active module of the rocking apparatus.

The active module 57 of FIG. 8 has a similar external configuration to the modules 48 including an external housing 58 and base 59. In this case however, the module 57 includes within the housing 58 a solenoid actuator 60 having a solenoid coil 61 and an armature 62 and a socket 63 (similar to the socket 51) is mounted to or formed integrally with the armature 62 for movement therewith. The actuator 60 is oriented such that the armature 62 thereof is substantially vertical when the base 59 is seated upon a horizontal surface.

Actuation of the solenoid actuator 60 by energising the coil 61 thereof will apply magnetic force to the armature 62 to cause it to move substantially vertically upwardly. A return spring 64 between the armature 62 and base 59 may be provided to restrain movement of the armature 62 and return the armature 62 from its extended position (shown in dotted outline) after the coil 61 is de-energised.

A control unit 64 is also provided within the housing 58 to control supply the current to the solenoid coil 61 from a power supply to which the module 57 is connected or from batteries within the housing 58. The housing 58 also includes a control knob or switch 65 connected to the control unit 64 for initiating operation of the module 57.

As with the embodiment of FIG. 1, one of the legs 12 of the cot may be supported on a module 57 and the remaining three legs supported on a module 48. Thus when current is supplied to the coil 61 under control of the knob or switch 65 and control unit 64, the armature 62 will lift the socket 63 as shown in dotted outline in FIG. 8 and apply a momentary vertical force to one leg 12 of the cot 11. Due to the spring mounting of the other three legs 12 on the support modules 48 provide by the springs 56, the momentary vertical force applied to the one leg 12 will induce an oscillating or rocking motion in the cot 11 and the springs 56 will facilitate the continuation of the reciprocating or oscillating motion of the cot 11. The solenoid actuator 60 is actuated at regular intervals under the control of the control unit 64 to maintain the oscillating or rocking motion in the cot 11. The rate of operation of the solenoid actuator 60 may be selectively by the control knob or switch 65 on the housing 58 of the module 57 so that optimum reciprocating or oscillating motion of the cot 11 can be achieved.

Figure 9:
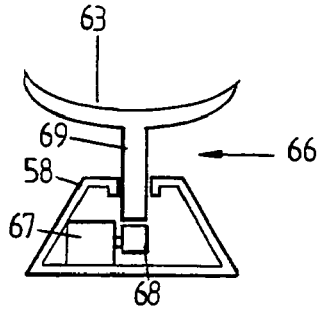
FIG. 9 illustrates a further form of active module of the rocking apparatus.

Referring now to FIG. 9, there is illustrated an alternative active module 66 which is similar to the module 57 of FIG. 8 and in which like components to the module of FIG. 8 have been given like numerals. In this case the oscillating motion to the socket 63 is created by means of a motor 67 within the housing 58 which is coupled to a cam 68. The lower end of the socket arm 69 is seated on the cam 68 such that when the motor 67 is operated to rotate the cam 68, the socket arm 69 and socket 68 will move vertically in opposite directions. To assist in the downward movement of the socket 63, a spring (not shown) may be provided to bias the socket 63 and arm 69 downwardly.

Figure 10:
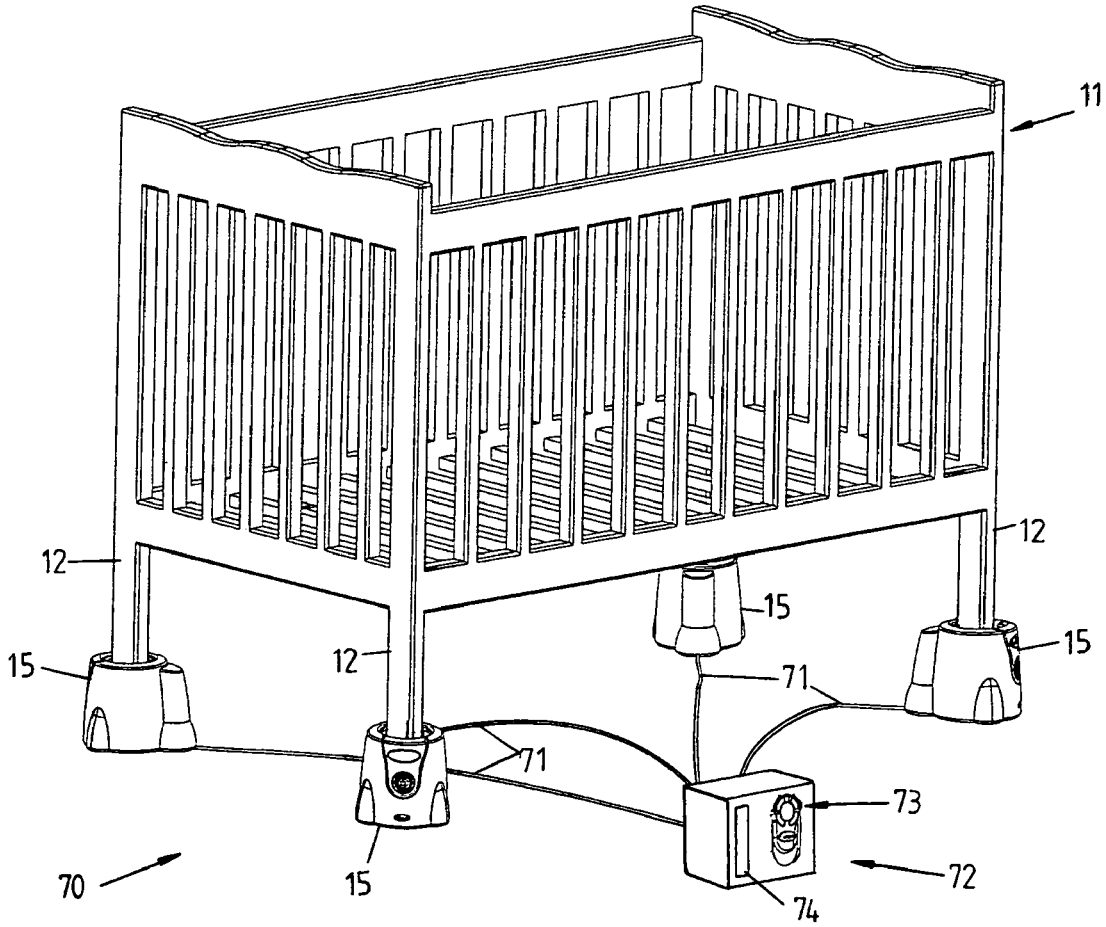
FIG. 10 illustrates a further form of rocking apparatus according to an embodiment of the invention associated with a cot.

Referring now to FIG. 10 there is illustrated an alternative embodiment of rocking apparatus 70 according to the invention again shown in association with a cot 11. In this case however, the legs 12 of the cot 11 are each supported on respective active support modules 15 which are all of the type shown in FIGS. 3 and 6 (or alternatively active support modules of the type shown in FIGS. 8 and 9). Further the modules 15 are connected by suitable connecting cables 71 to a common controller 72. The controller 72 may include a power supply for connection to the modules 15 to cause actuation of the solenoids 28 of one or more of the modules 15. The power supply for example may comprise batteries. Alternatively, the controller 72 may be connectable to an external power supply such as a mains supply.

The controller 72 includes a programmable microprocessor which controls the application of current from the power supply to each of the solenoid actuators 28 of each support module 15. Each actuator 28 accordingly can be actuated independently of the other actuators 28. Furthermore the microprocessor can control the stroke and speed or movement of the armature 30 of each actuator 28 such that each armature 30 can have a different stroke when actuated. The microprocessor of the controller 72 can also control the phase of operation of each actuator 28.

In use and when the cot 11 is supported on the support modules 15 as in FIG. 10 and a baby or infant placed within the cot 11, the controller 72 through operation of one or more of the external switches 73 can cause current to be supplied to the solenoid coils 29 of selected modules. The current is supplied momentarily to the coils 29 to impart a vertical reciprocating motion in the cot 11 through the leg 12 at each corner of the cot 11. The motion imparted at each corner may be different from the motion imparted at the other corners either by having the armatures 29 operating at a different stroke and/or out of phase with each other.

The motion thus imparted in the cot 11 will be an irregular rocking motion similar to the motion for example of a motor vehicle. It has been found that such a motion is particularly effective in inducing sleep in babies or infants within the cot 11.

The controller 72 may also include a timer which will switch off the power supply to the solenoid actuators 29 after a predetermined time which may be varied by the switches 73 on the controller 72. Furthermore the controller 72 may also incorporate a player 74 of compact discs or a tape player or alternatively a solid-state memory device which stores music recording or other sounds. Such a device or player may be actuated when the controller 72 is actuated so that relaxing music is played at the same time as actuation of the support modules 15.

The controller 72 may be programmed to provide specific motions to the cot 11. For example, two modules 15 on one side of the cot 11 may be actuated simultaneously and regularly and the two modules 15 on the opposite side of the cot 11 also actuated simultaneously and regularly but out of phase with the actuation of the modules 15 on the one side of the cot 11. This will induce a side-to-side rocking motion in the cot 11. In a similar manner, the modules 15 may be actuated to induce an end-to-end rocking motion in the cot 11.

Whilst the apparatus described above is particularly suited for use wit infant or baby cots, it may also be used as referred to with prams or strollers with the selected support modules or combination of active and/or passive modules located under each wheel. Usually in this case it is preferred that the apparatus be portable and therefore each active module includes its own power supply such as batteries to allow the apparatus to be used in locations where mains power is not available.

Further whilst the actuators of the apparatus are described as solenoid actuators, they may comprise other forms of electrical actuator. In some embodiments also it is possible to use employ mechanical actuators such as spring driven actuators.

In the embodiments of rocking apparatus described above, the active and passive support modules are shown as being separate from the cot 11 (or other enclosure to be supported). In some embodiments, the active and/or passive modules may be incorporated into the legs of the enclosure.

The terms "comprising" or "comprises" as used throughout the specification and claims are taken to specify the presence of the stated features, integers and components referred to but not preclude the presence or addition of one or more other feature/s, integer/s, component/s or group thereof.

Whilst the above has been given by way of illustrative embodiment of the invention, all such variations and modifications thereto as would be apparent to persons skilled in the art are deemed to fall within the broad scope and ambit of the invention as defined in the appended claims.

The invention claimed is:

1. Apparatus for moving or rocking an infant enclosure of the type having at least three legs by which said enclosure is normally supported on an underlying surface, said apparatus comprising a plurality of support modules associated with respective said legs and positioned in use between said legs and said surface, each said support module having a socket or saddle for receiving the lower end of a leg of the enclosure, each support module including resilient support means providing independent and resilient support for each said leg, one of said support modules including a solenoid actuator for causing when actuated repeated resilient compression of said resilient support means of said one support module for imparting a substantially vertical oscillating or reciprocating motion to a first leg of said enclosure supported on said one support module, said solenoid actuator having an armature and a coil, said armature of said solenoid being rigidly connected to the socket or saddle and being oriented substantially vertically whereby current applied to said coil causes said coil to move substantially vertically along the armature and thereby cause compression of said resilient support means and the resilient support means of said other support modules causing movement of the other legs of said enclosure upon motion being imparted to said first leg of said enclosure by said solenoid actuator of said one support module to continue motion of said enclosure, and means for selectively actuating said solenoid actuator.

2. Apparatus as claimed in claim 1 wherein said resilient support means comprise springs.

3. Apparatus as claimed in claim 1 wherein said socket or saddle is mounted on said resilient support means.

4. Apparatus as claimed in claim 3 wherein each said support module comprises a housing and wherein said resilient means comprises a compression spring housed in said housing.

5. Apparatus as claimed in claim 1 wherein said coil is weighted to increase the momentum thereof when said actuator is actuated.

6. Apparatus as claimed in claim 1 and including springs for cushioning movement of the coil.

7. Apparatus as claimed in claim 1 wherein said at least one support module includes control means to control the supply of current to the solenoid coil and a remote control unit associated with said control means.

8. Apparatus for moving or rocking an infant enclosure of the type having at least three legs by which said enclosure is normally supported on an underlying surface, said apparatus comprising at least three support modules associated with a respective said leg of said enclosure and providing independent support for each said leg on said surface, each said support module including a socket or saddle for receiving a lower end of a said leg, each said socket or saddle being mounted on a resiliently compressible spring, one of said support modules comprising an active support module for supporting one said leg of said enclosure and wherein others of said support modules comprise passive support modules for supporting other said legs of said enclosure, said active support module including an actuator having substantially vertically oriented actuator member, said actuator member being movable relative to said socket or saddle of said active support module, and means for selectively actuating said actuator to cause reciprocating or oscillating movement of said actuator member, said movement of said actuator member causing repeated resilient compression of said spring of said active support module to impart a substantially vertical oscillating or reciprocating motion to said socket or saddle of said active support module and to said one leg of said enclosure, and wherein said springs of said passive support modules facilitate the continuation of motion imparted in the enclosure by said at least one active support module.

9. Apparatus as claimed in claim 8 wherein said actuator comprises a solenoid having an armature and coil, said armature being connected to said socket or saddle of said active support module and said coil comprising said actuator member, said coil being weighted to increase the momentum thereof when moved relative to said armature.

10. Apparatus as claimed in claim 9 wherein said socket or saddle of said active support module includes a laterally extending arm, said armature of said solenoid being connected to and depending from said arm and there being provided cushioning springs connecting said coil to said arm.

11. Apparatus as claimed in claim 9 and including a remote control actuator for remotely actuating said solenoid.

12. Apparatus as claimed in claim 9 and including control means for applying a pulsed supply of current to said solenoid to cause reciprocation or oscillation of said actuator member.

13. Apparatus for moving or rocking an infant enclosure comprising a cot having four supporting legs, said apparatus comprising four support modules associated with respective said legs and providing independent support for each said leg on a support surface, each said support module including a socket or saddle for receiving and supporting a lower end of a said leg, each said socket or saddle being mounted on a resiliently compressible spring, one of said support modules comprising an active support module for supporting one said leg of said cot and wherein the others of said support modules comprise passive support modules for supporting the other said legs of said cot, said active support module including a solenoid actuator having an armature and a coil, said armature being substantially vertically oriented and being connected to said socket or saddle and said coil being movable along said armature and relative to said socket or saddle of said active support module when said actuator is actuated, and means for selectively actuating said actuator to cause reciprocating or oscillating movement of said coil along said armature, the movement of said coil causing repeated resilient compression of said spring of said active support module to impart a substantially vertical oscillating or reciprocating motion to said socket or saddle of said active support module and to said one leg of said cot, and wherein said springs of said passive support modules facilitate the continuation of motion imparted in the cot by said at least one active support module.

14. Apparatus for moving or rocking an infant enclosure of the type having at least three legs by which said enclosure is normally supported on an underlying surface, said apparatus comprising a plurality of support modules on or in which respective legs of the enclosure are supported, each said support module including a socket or saddle for receiving the lower end of a leg of the enclosure, said support modules being positioned in use between said legs and said surface, said support modules including resilient support means providing independent and resilient support for each said leg, one of said support modules including a solenoid actuator having first and second solenoid members, one said member comprising an armature and the other said member comprising a coil, said first solenoid member being oriented in a substantially vertical attitude and being connected to the socket or saddle and the second solenoid member being adapted to be selectively reciprocated or oscillated relative to said first solenoid member to cause when actuated repeated resilient compression of said resilient support means of said one support module for imparting a substantially vertical oscillating or reciprocating motion to a first leg of said enclosure supported on said one support module and wherein the resilient support means of said other support modules cause movement of the other legs of said enclosure upon motion being imparted to said first leg of said enclosure by said actuator of said one support module to continue motion of said enclosure, control means associated with said one support module to control the supply of current to the solenoid coil of said actuator for actuating said actuator and a remote control unit associated with said control means.

* * * * *